US010151454B2

(12) United States Patent
Farrell et al.

(10) Patent No.: US 10,151,454 B2
(45) Date of Patent: Dec. 11, 2018

(54) END CAP FOR LIGHT FIXTURE

(71) Applicant: Hubbell Incorporated, Shelton, CT (US)

(72) Inventors: Timothy Scott Farrell, Swansea, MA (US); Derek Bruce Baker, Middleborough, MA (US)

(73) Assignee: Hubbell Incorporated, Shelton, CT (US)

( * ) Notice: Subject to any disclaimer, the term of this patent is extended or adjusted under 35 U.S.C. 154(b) by 69 days.

(21) Appl. No.: 15/236,559

(22) Filed: Aug. 15, 2016

(65) Prior Publication Data

US 2017/0051894 A1 Feb. 23, 2017

Related U.S. Application Data

(60) Provisional application No. 62/206,436, filed on Aug. 18, 2015.

(51) Int. Cl.

| | |
|---|---|
| ***F21V 21/00*** | (2006.01) |
| ***F21V 15/015*** | (2006.01) |
| ***F21V 21/005*** | (2006.01) |
| ***F21V 17/10*** | (2006.01) |
| *F21Y 115/10* | (2016.01) |
| *F21Y 103/10* | (2016.01) |

(52) U.S. Cl.

CPC ..... *F21V 15/015* (2013.01); *F21V 17/104* (2013.01); *F21V 17/105* (2013.01); *F21V 17/108* (2013.01); *F21V 21/005* (2013.01); *F21Y 2103/10* (2016.08); *F21Y 2115/10* (2016.08)

(58) Field of Classification Search

CPC ..... F21V 15/015; F21V 17/105

See application file for complete search history.

(56) References Cited

U.S. PATENT DOCUMENTS

| | | | | |
|---|---|---|---|---|
| 4,856,216 | A | 8/1989 | Gross | |
| 9,618,189 | B1 * | 4/2017 | Eubanks | F21V 17/105 |
| 2011/0084627 | A1 * | 4/2011 | Sloan | F21V 15/013 315/297 |
| 2013/0155670 | A1 | 6/2013 | Handsaker | |

(Continued)

OTHER PUBLICATIONS

PCT International Search Report for corresponding PCT Application No. PCT/US2016/46963, dated Oct. 31, 2016, 2 pages.

(Continued)

*Primary Examiner* — Sean Gramling

(74) *Attorney, Agent, or Firm* — Dority & Manning, P.A.

(57) ABSTRACT

End caps for light fixtures that can be used, for instance, to reduce light leaks along lens seams and gaps are provided. In one example embodiment, a light fixture can have a fixture body. The fixture body can have an end portion. The light fixture can further include a lens and a light source positioned within the fixture body so as to provide light through the lens. The light fixture can further include an end cap having a cover plate. The cover plate can have a shape adapted to cover at least a portion of the end portion of the fixture body. The end cap can further include a magnetic coupling element configured to removably secure the end cap to the fixture body. The end cap can have a top portion configured to overlap at least a portion of the lens when the end cap is secured to the fixture body.

16 Claims, 7 Drawing Sheets

(56) References Cited

U.S. PATENT DOCUMENTS

2014/0268720 A1 8/2014 Dungan et al.
2016/0290571 A1* 10/2016 Chamberlain ..... F21V 19/004

OTHER PUBLICATIONS

NEO-RAY Linear Recessed Luminaire Brochure, Mar. 2015—15 pages.
PCT International Preliminary Report on Patentability for corresponding PCT Application No. PCT/US2016/46963, dated Feb. 20, 2018, 9 pages.

* cited by examiner

END CAP FOR LIGHT FIXTURE

FIELD

The present disclosure relates generally to light fixtures and more particularly to end caps for light fixtures.

BACKGROUND

Light fixtures can be installed to provide illumination for various spaces. One example light fixture configuration is a linear or rectilinear light fixture. Linear light fixtures can have a long dimension (e.g. length) that is greater than a short dimension (e.g. width) of the fixture so that the light fixture has a generally linear shape. Linear light fixtures can be installed so as to be suspended from a ceiling, mounted on a wall, recessed in a surface, or can have other suitable installation configurations. In some applications, linear light fixtures can be installed in an end-to-end arrangement where an end of a light fixture is installed immediately adjacent to an end of another light fixture to provide lighting across the length of a room or other space.

A light fixture can include a lens installed across the length of the light fixture. Due to lens cut tolerances and/or expansion and contraction of the lens, there can be a gap at the end portion of the light fixture or junctions between different light fixtures. The gap can lead to light leak and visibility of lamps and/or other light sources (e.g. light emitting diodes) and inner mechanics in the fixture as well as dust penetration into the fixture. The leakage of light and exposure of the light sources can lead to decreased aesthetics and effectiveness of the light fixtures.

End caps for light fixtures have been developed for reducing light leakage at the ends of the fixtures. However, certain end cap mechanical configurations can make it difficult to remove or adjust the lens for access to the inner electronics and/or light sources of the fixture. In addition, traditional nut and bolt style mounting of end caps can lead to increased complexity to the installation and removal of the end cap.

SUMMARY

Aspects and advantages of embodiments of the present disclosure will be set forth in part in the following description, or may be learned from the description, or may be learned through practice of the embodiments.

One example aspect of the present disclosure is directed to a light fixture having a fixture body. The fixture body can have an end portion. The light fixture can further include a lens and a light source positioned within the fixture body so as to provide light through the lens. The light fixture can further include an end cap having a cover plate. The cover plate can have a shape adapted to cover at least a portion of the end portion of the fixture body. The end cap can further include a magnetic coupling element configured to removably secure the end cap to the fixture body. The end cap can have a lop portion configured to overlap at least a portion of the lens when the end cap is secured to the fixture body.

Another example aspect of the present disclosure is directed to an end cap for a light fixture. The end cap can include a cover plate. The end cap can further include a lip portion extending from the cover plate. The end cap can further include a magnetic coupling element. The magnetic coupling element can provide for removable engagement between the end cap and an end portion of a linear light fixture.

Other example aspects of the present disclosure can include apparatus, light fixtures, lighting systems and methods that include or relate to one or more end caps capable of being secured to a light fixture. Variations and modifications can be made to example aspects of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
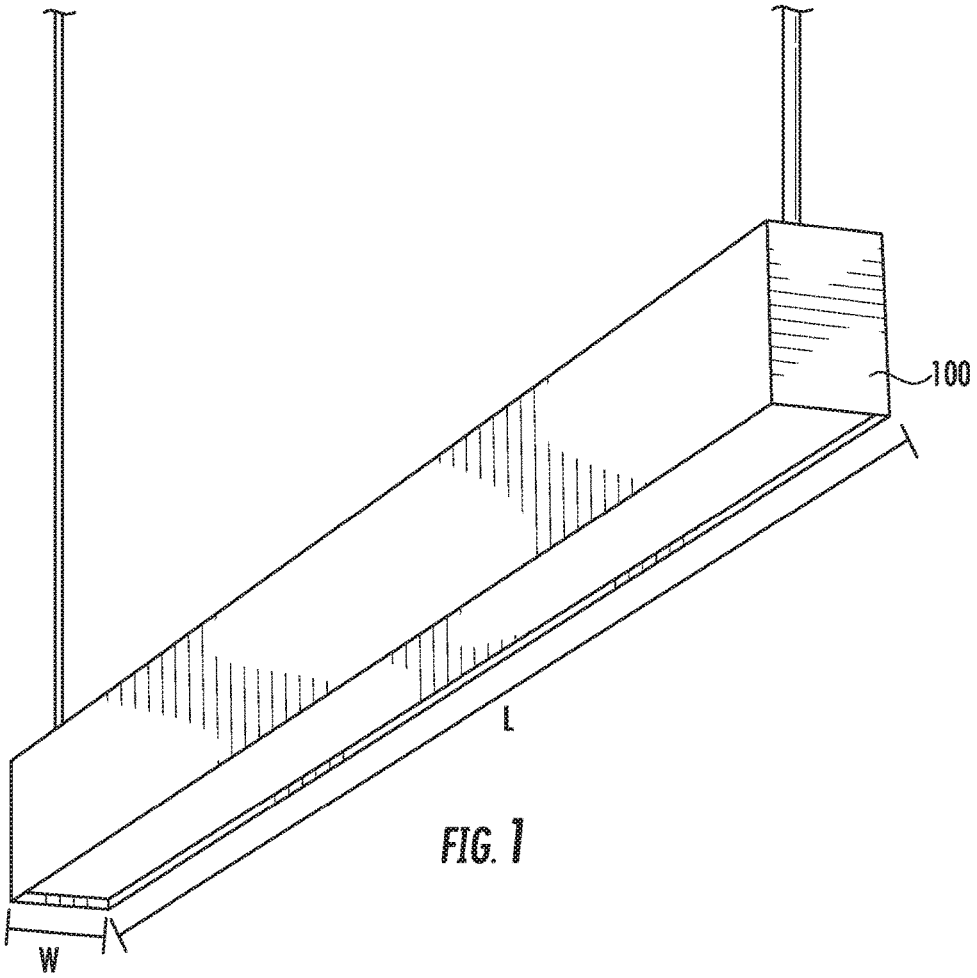
FIG. 1 depicts an example linear light fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to end caps for light fixtures that can be used, for instance, to reduce light leaks along lens seams and gaps associated with the light fixture. One example end cap according to example embodiments of the present disclosure can include a cover plate and a lip portion that can be positioned to overlap an edge of a lens installed in a light fixture to at least partially cover or eliminate gaps to reduce light leak. According to particular aspects of the present disclosure, a magnetic coupling element (e.g., one or more permanent magnets, magnetic material, etc.) can be used to secure the end cap to a fixture body. The use of a magnetic coupling element for securing the end cap to the fixture body can significantly facilitate the installation and removal of the end cap. In this way, the process of installing and/or adjusting a lens associated with a fixture and installing the end cap to cover a gap at the end of the fixture or between fixtures can be simplified and performed without having to utilize tools or other devices.

Example embodiments of the present disclosure can include an end cap for use with, for instance, a pendant mount, wall mount, or surface mount linear light fixture. The end cap can include one or more magnets configured to engage an end portion of the light fixture using a magnetic force. A lip along an edge of the end cap can overlap a portion of a surface of the lens, thereby covering an otherwise apparent gap and preventing visibility into the fixture. In addition, the end cap can include one or more ribs that can be configured to overlap gaps along one or more sides of the fixture. The end cap can be easily removed, without having to utilize any tools, to remove the lens of the fixture for service and maintenance. For example, in end-to-end configurations, the end cap can be easily removed to allow for tightening of the seam between adjacent lenses. The end cap can be installed to cover any gap at an end portion of the arrangement of light fixtures resulting from the tightening of the seams.

Another example embodiment of the present disclosure can include an end cap having a cover plate configured to slide relative to a fixture body. The cover plate can include a lip that can be positioned to overlap an edge of an installed lens in a light fixture to reduce or eliminate gaps. The cover plate can be configured to slide up and down a track to facilitate removal of the lens. In one embodiment, the cover plate can include one or more slots configured to slide relative a protrusion (e.g. a screw) in the fixture. A magnetic coupling element can be used to engage the cover plate to prevent the force of gravity from causing the end plate to slide once installed. In one particular implementation, the cover plate can include a V-cut that is configured to assist with disengaging the end cap from the magnetic coupling element installed on the fixture to facilitate removal and adjustment of the lens.

With reference now to the FIGS., example embodiments of the present disclosure will now be discussed in detail. FIG. 1 depicts an example light fixture 100. The light fixture 100 is a linear light fixture that can be suitable for pendant mounting. The light fixture 100 can also be suitable for wall mount installation, ceiling mount installation or other suitable installation without deviating from the scope of the present disclosure. The linear light fixture 100 includes a length dimension L that is greater than the width dimension W. For instance, the length dimension L can be at least two times the width dimension W, such as at least three times the width dimension W, such as at least five times the width dimension W, such as at least ten times the width dimension W. The light fixture 100 depicted in FIG. 1 is a rectilinear light fixture. Those of ordinary skill in the art, using the disclosures provided herein, will understand that end caps according to example aspects of the present disclosure can be used with other suitable types of fixtures without deviating from the scope of the present disclosure.

Figure 2:
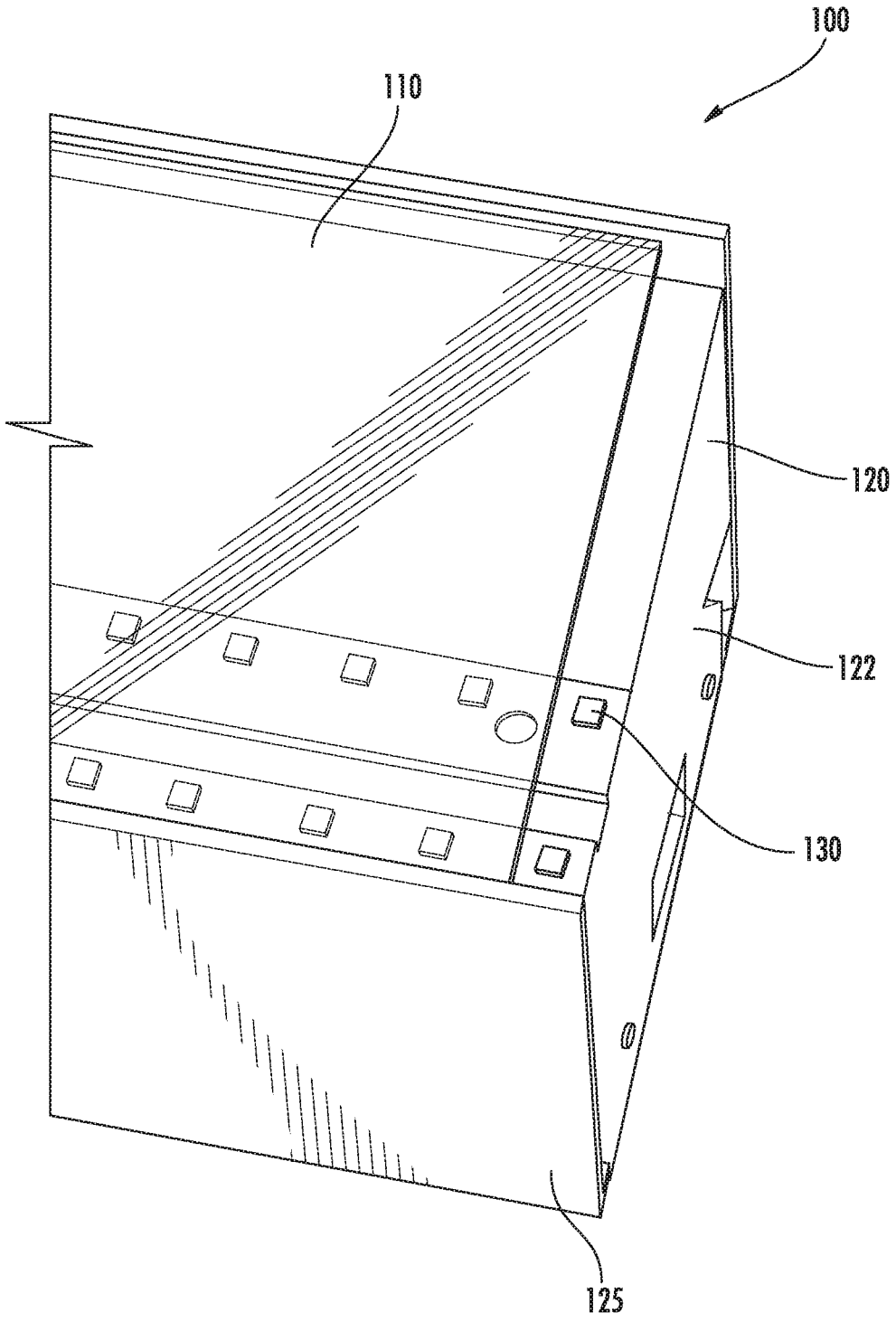
FIG. 2 depicts an example light fixture that can be engaged with an end cap according to example embodiments of the present disclosure.

FIG. 2 depicts a close up of an end portion of the light fixture 100. As shown, the light fixture 100 includes a fixture housing 120 and a lens 110. The fixture housing 120 can house one or more light sources 130, such as LED light sources as well as one or more power circuits for providing power to the light sources 130. The light sources 130 can be positioned within the housing so as to provide light through the lens 110.

The fixture housing 120 can include sidewalls 125. The sidewalls 125 can be manufactured from a suitable material, such as aluminum, steel, or plastic. The fixture housing 120 can further include an end portion 122. In some embodiments, the end portion 122 can have an external surface, at least a portion of which can be formed from a magnetic material. The magnetic material can be any material that can be attracted to a magnet (e.g., a permanent magnet), such as steel, iron, cobalt, and/or alloys or mixtures thereof.

The lens 110 can be configured to be received in the fixture housing 120. For instance, the lens 110 can be configured to be engaged between sidewalls 125 of the fixture housing 120. The lens 110 can be a glass, polycarbonate, acrylic, or silicone lens (with or without UV protection). Due to, for instance, lens cut tolerances and/or expansion and contraction of the lens 110, there can be a gap at the end portion of the light fixture 100 or junctions between different light fixtures (e.g., in end-to-end configurations), when the lens 110 is installed in the light fixture 100. For instance, as shown in FIG. 2, the lens 110 does not extend all of the way to the end of the light fixture 100, leading to exposure of at least one of the light sources 130, causing light leak.

Figure 3:
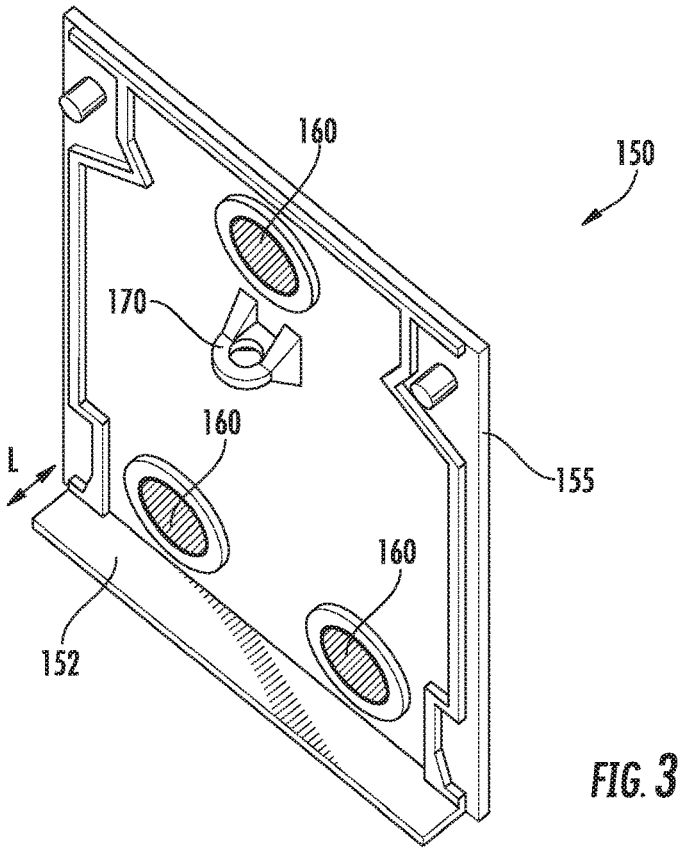
FIG. 3 depicts a perspective view of an end cap according to example embodiments of the present disclosure.

FIG. 3 depicts a perspective view of an example end cap 150 that can be used in conjunction with the light fixture 100. The end cap 150 can include a generally rectangular cover plate 155 that has a size and shape configured to match or cover at least a portion of an end portion 122 of the fixture housing 120 (shown in FIG. 2). Other suitable geometries of the cover plate 155 are contemplated, such as circular, square, polygonal, elliptical, triangular, or other suitable geometry. The cover plate 150 can be manufactured from any suitable material, such as aluminum, steel, plastic, etc.

The end cap 150 includes a lip portion 152 extending from a perimeter of the cover plate 155. More particularly, the lip portion 152 extends in a perpendicular direction from the cover plate 155. The lip portion 152 has a length L. The length L 152 can be selected such that when the end cap 150 is secured to the fixture 100, the lip portion 152 overlaps at least a portion of the lens 120 installed in the light fixture 100. In some embodiments, the lip portion 152 can be integral or integrally assembled with the cover plate 155 such that the cover plate 155 and the lip 152 are one piece.

According to example aspects of the present disclosure, the end cap 120 can include means for removably securing the end cap to the light fixture. Example means for removable securing the end cap to the light fixture are illustrated in FIGS. 3-10. In the example embodiment of FIG. 3, the end cap 150 further includes at least one magnetic coupling element. The magnetic coupling element can provide for the removable engagement between the end cap 120 an end portion of a light fixture (e.g., light fixture 100).

More particularly, in the embodiment of FIG. 3, the end cap 150 includes a plurality of permanent magnets 160 (e.g., rare-earth magnets) disposed on the cover plate 155. Three permanent magnets 160 are depicted in FIG. 3 for purposes of illustration and discussion. Those of ordinary skill in the art, using the disclosures provided herein, will understand that more or fewer permanent magnets can be disposed on the end cap without deviating from the scope of the present disclosure. The permanent magnets 160 can be engaged with the magnetic material of the end portion 122 of the fixture housing 120 to removably secure the end cap 150 to the fixture 100 using a magnetic force. A user or technician can easily remove the end cap 150 from the fixture 100 by applying enough force to overcome the magnetic force provided by the permanent magnets 160 and the magnetic material of the end portion 122 of the fixture housing 120.

According to other example embodiments of the present disclosure, the permanent magnets can be installed on the fixture 100. The cover plate 155 can have a surface at least a portion of which is formed from a magnetic material. The cover plate 155 can be engaged with the fixture 100 by engaging the magnetic material on the cover plate 155 with the permanent magnets installed on the fixture. The magnetic force between the cover plate 155 and the permanent magnets can secure the end cap to the fixture. A user or technician can easily remove the end cap 150 from the fixture 100 by applying enough force to overcome the magnetic force provided by the permanent magnets and the magnetic material of the cover plate 155.

Figure 4:
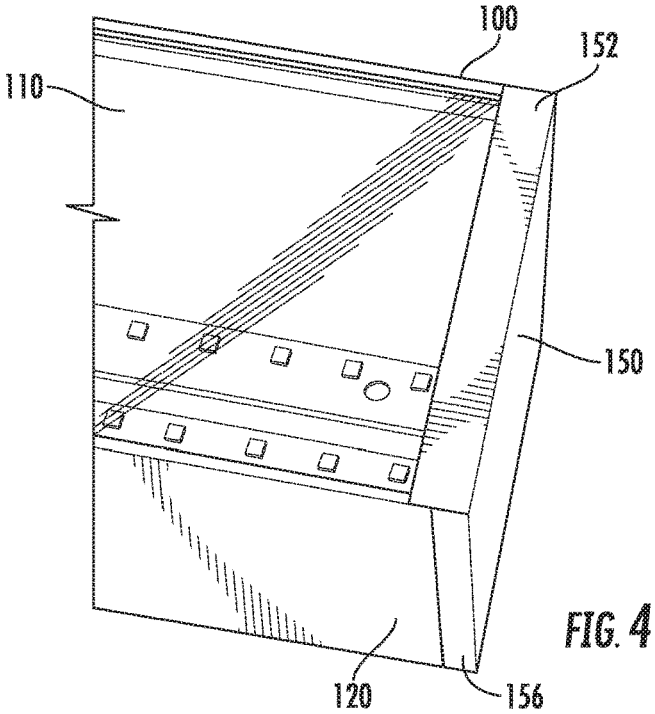
FIG. 4 depicts an end cap secured to a light fixture according to example embodiments of the present disclosure.

FIG. 4 depicts the end cap 150 installed on the light fixture 100. As shown, the lip portion 152 overlaps at least a portion of the lens 110. In this way, gaps between the lens 110 and an end portion of the light fixture 100 can be covered by the lip portion 152 of the end cap 150, leading to reduced light leak. In example embodiments, the end cap 150 can further include at least one side rib 156. The side rib 156 can overlap a portion of the sidewalls 125 of the fixture housing 120 to further reduce light leak and exposure of internal components of the light fixture 100.

Referring back to FIG. 3, the end cap 150 can further include a hook element 170 or other element configured to receive at least a portion of a tether (e.g. a chain, wire, etc.). The tether can be used to attach the end cap 150 to the fixture 100 so that when the permanent magnets 160 are disengaged from the fixture housing 120, the end cap 150 can still be attached to the fixture 100 via the tether. A hook element 170 is depicted in FIG. 3 for receiving a portion of the tether. Those of ordinary skill in the art, using the disclosures provided herein, will understand that other suitable elements can be used to secure a tether without deviating from the scope of the present disclosure. In addition, the end cap 150 can be secured to the fixture 100 using other mechanical means, such as integral clips, geometry configured to match the fixture, etc.

Figure 5:
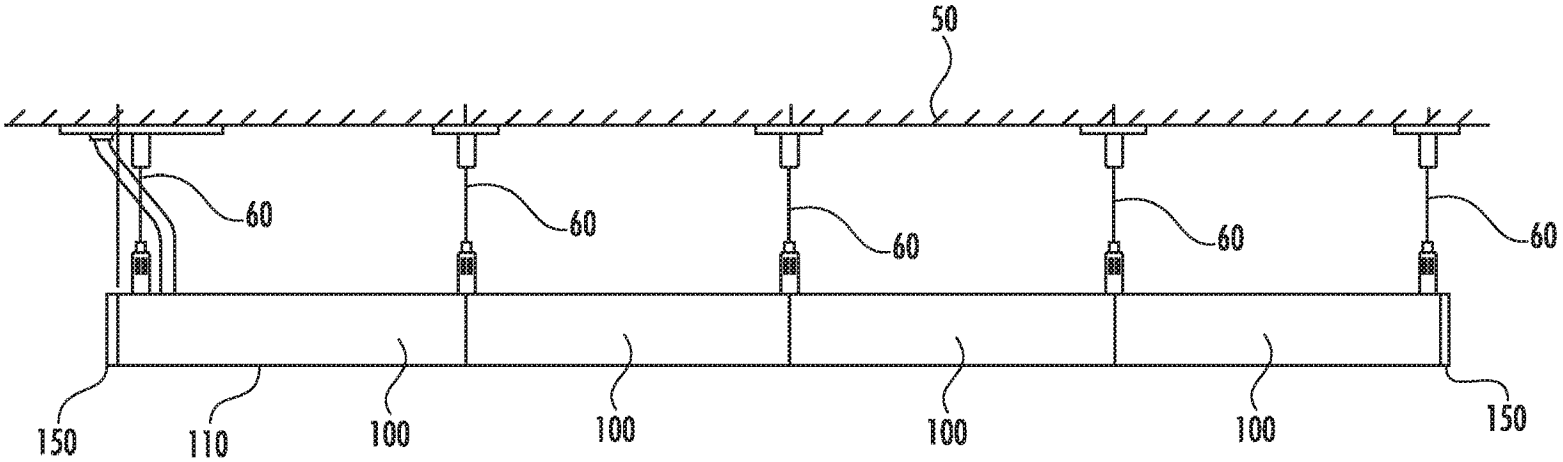
FIG. 5 depicts an example end-to-end configuration of linear light fixtures according to example embodiments of the present disclosure.

FIG. 5 depicts an example end-to-end arrangement of a plurality of light fixtures 100 according to example embodiments of the present disclosure. More particularly, four linear light fixtures 100 are coupled together in an end-to-end arrangement. The light fixtures 100 can be suspended from a ceiling 50 using suitable pendant mounts 60. Other suitable mounting installations can be used without deviating from the scope of the present disclosure. One or more lenses 110 can be installed in the end-to-end arrangement of linear light fixtures 100. As discussed above, lens cut tolerances and/or expansion and contraction of the lens 110, there can be a gap at the end portion of a light fixture 100 or at junctions between different light fixtures when the lens 110 is installed in the light fixture 100. As shown, in FIG. 5, an end cap 150 according to example aspects of the present disclosure can be installed relative to end portions of linear light fixtures 100 to reduce light leak in the end-to-end arrangement of linear light fixtures 100.

Figure 6:
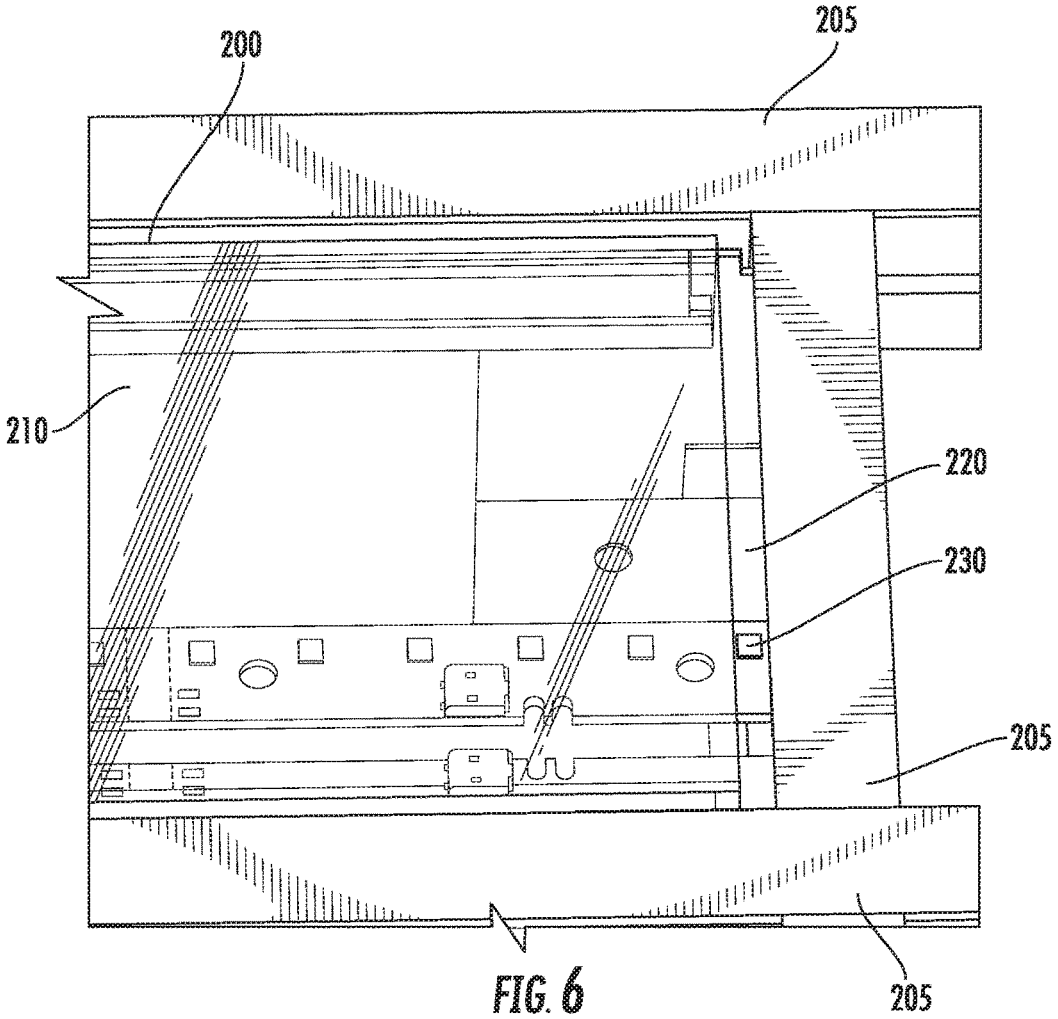
FIG. 6 depicts a recessed light fixture that can be engaged with an end cap according to example embodiments of the present disclosure.

FIG. 6 depicts a portion of a recessed light fixture 200 installed, for instance, in a ceiling. Similar to the fixture 100 of FIG. 2, the fixture 200 of FIG. 6 includes a lens 210 and a fixture housing 220. The fixture housing 220 can house one or more light sources 230, such as LED light sources. The fixture housing 120 can further include an end portion 225 (shown in FIG. 8). In some embodiments, the end portion 255 can be formed from a material, such as steel, iron, aluminum, or alloys and/or mixtures thereof.

The lens 210 can be configured to be received in the fixture housing 220. The lens 210 can be a glass, polycarbonate, acrylic, or silicone lens (with or without UV protection). Due to, for instance, lens cut tolerances and/or expansion and contraction of the lens 210, there can be a gap at the end portion of the light fixture 200 or junctions between different light fixtures, when the lens 210 is installed in the light fixture 200. For instance, as shown in FIG. 6, the lens 210 does not extend all of the way to the end of the light fixture 200, leading to exposure of at least one of the light sources 230.

In the example of FIG. 6, the light fixture 200 is recessed within a ceiling including a ceiling grid 205. The ceiling can be include suitable ceiling materials and components, such as one or more variations of ceiling grid, sheet rock, wood, etc. The ceiling grid 205 can make it difficult to access an end portion of the fixture 200 to removably secure an end cap to the fixture 200 for the purposes of covering the gap at the end portion of the fixture 200.

Figure 7:
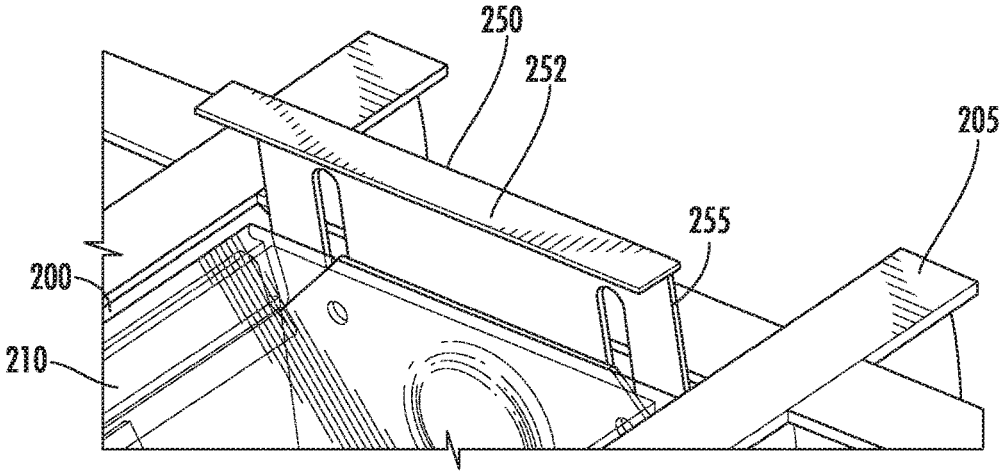
FIG. 7 depicts an end cap according to example embodiments of the present disclosure secured to a recessed light fixture.

FIG. 7 depicts an end cap 250 according to another example embodiment of the present disclosure that can be particularly suitable for used with recessed fixtures, such as fixture 200. As shown in FIG. 7, the end cap 250 includes a cover plate 255 and a lip portion 252. The lip portion 252 can be configured to overlap at least a portion of the lens 210 of the fixture 200 when the end cap 250 is secured to the fixture 200. In this way, a gap at the end portion of the light fixture 200 or at a seam between light fixtures can be covered by the lip portion 252, leading to reduced light leak.

Figure 8:
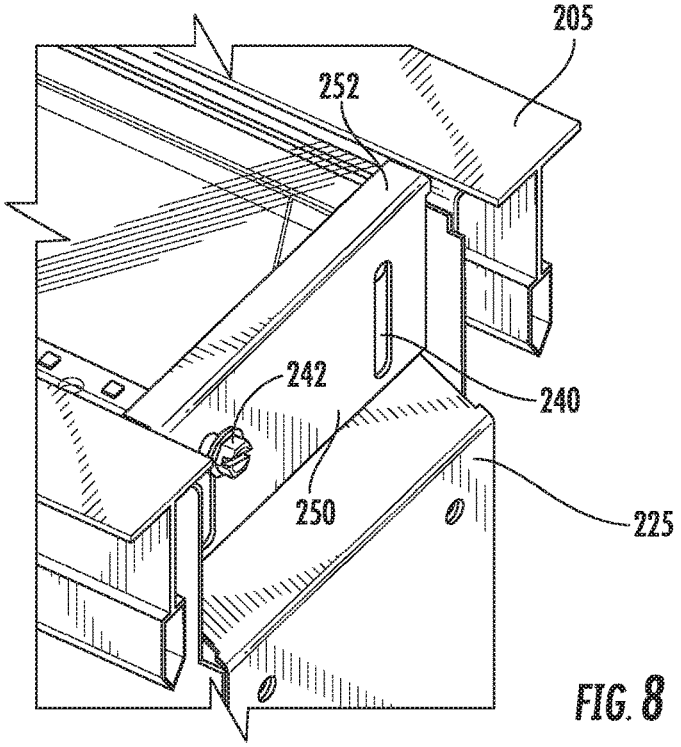
FIG. 8 depicts a first position of an end cap for a recessed light fixture according to example embodiments of the present disclosure.
Figure 9:
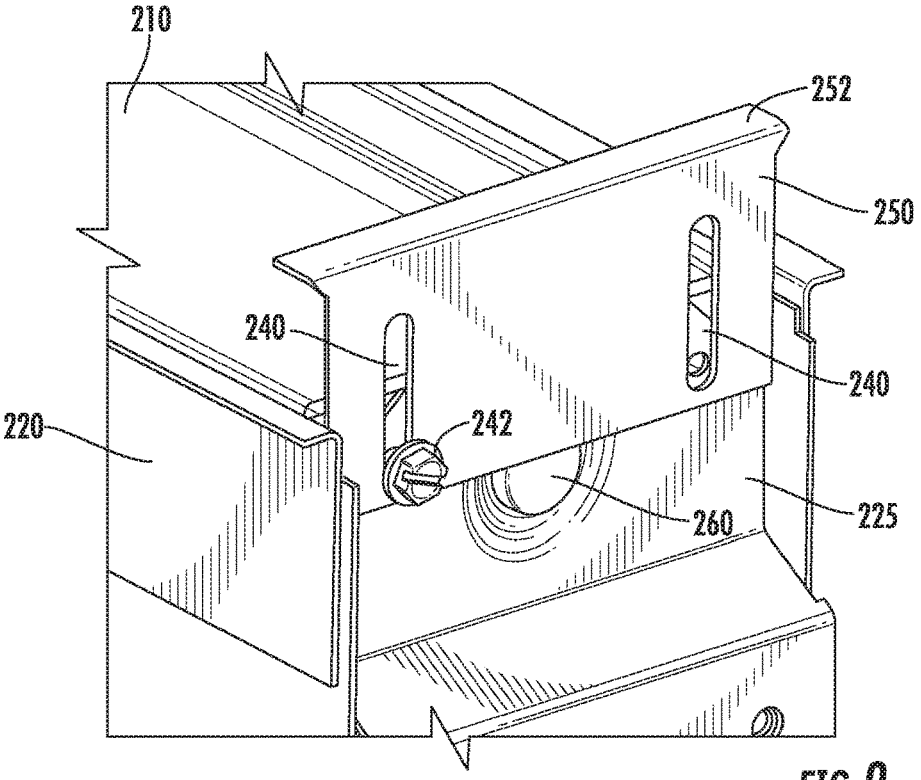
FIG. 9 depicts a second position of an end cap for a recessed light fixture according to example embodiments of the present disclosure.

To facilitate securing the end cap 250 to the recessed fixture 200, the end cap 250 can be slidably mounted to an end portion 225 of the fixture body 220. FIGS. 8 and 9 illustrate the ability of the end cap 250 to slide relative to the fixture body 220. The end cap 250 includes a plurality of tracks 240. In the example embodiment of FIGS. 8 and 9, the tracks 240 include slots provided in the cover plate 255. The tracks 240 engage with a protrusion 242 that is extending from the end portion 225 of the fixture housing 220. In some embodiments, the protrusion is a screw, bolt, or similar element that is not tightened so that the end cap 250 can freely slide between a first position (e.g., shown in FIG. 8) and a second position (e.g., shown in FIG. 9). Other suitable track configurations can be used without deviating from the scope of the present disclosure, such as recesses, grooves, or other features configured to engage with a portion of the fixture housing to allow the end cap 250 to slide relative to the fixture 200.

In FIG. 8, the end cap 250 is located in a first position relative to the fixture housing 220. In the first position, the lip portion 252 of the end cap 250 overlaps at least a portion of the lens 210, covering gaps in the light fixture 200. In FIG. 9, the end cap 250 is in a second position relative to the fixture housing 220. When the end cap 250 is in the second position, the lens can be accessed for adjustment and/or maintenance purposes.

To prevent the force of gravity from causing the end cap 250 to slide from the first position to the second position when installed, the end cap 250 can include a magnetic coupling element. In particular, the cover plate 255 can have a surface at least a part of which can be formed from a magnetic material. The magnetic material can be any material that can be attracted to a magnet (such as a permanent magnet). For instance, the magnetic material can be steel, iron, cobalt, and/or alloys or mixtures thereof.

The magnetic material of the cover plate 255 can be configured to engage with one or more permanent magnets 260 (e.g., rare-earth magnets) installed on the end portion 225 of the fixture housing 220. The magnetic force between the permanent magnet(s) 260 and the magnetic material of the end cap 250 can prevent the end cap from sliding to the second position relative to the fixture 200 when installed. To access the lens or interior of the fixture 200, a user or technician can provide a downward force to overcome the magnetic force between the permanent magnet 260 and the magnetic material to cause the end cap 250 to slide to the second position.

Figure 10:
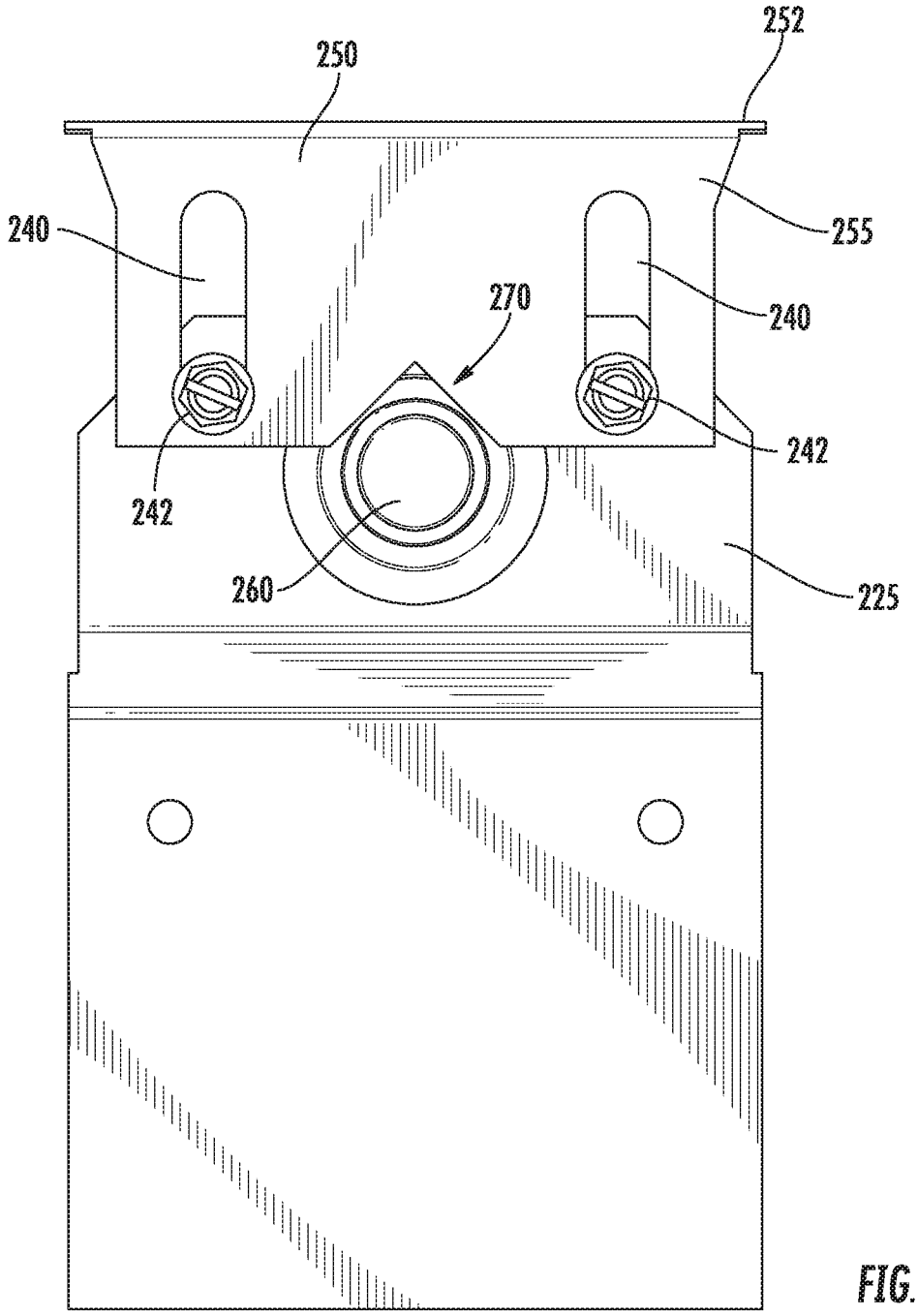
FIG. 10 depicts an end cap for a light fixture according to example embodiments of the present disclosure.

In some embodiments, the end cap 250 can include a V-shaped slot 270 in the cover plate 255 as depicted in FIG. 10. The V-shaped slot 270 can facilitate sliding the end cap 250 from the first position to the second position. More particularly, because of the V-shaped slot, less movement of the end cap 250 is required to disengage the magnetic material of the cover plate 255 from the permanent magnet 260. Accordingly, less force may be required to move the end cap 250 from the first position to the second position to access the lens 210 or interior of the fixture 200.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An end cap for a light fixture, comprising:
a cover plate;
a side rib;
a lip portion extending from the cover plate; and
a magnetic coupling element disposed on the end cap, the magnetic coupling element-configured to removably secure the end cap to an external surface of an end portion of a fixture body of the light fixture,
wherein when the end cap is removably secured to the external surface of the end portion, the lip portion of the end cap covers a gap defined between the end portion and a lens of the lighting fixture, and
wherein when the end cap is removably secured to the external surface of the end portion, the side rib covers a portion of an external surface of a sidewall of the fixture body.

2. The end cap of claim 1, wherein the magnetic coupling element comprises one or more permanent magnets disposed on the cover plate.

3. The end cap of claim 1, wherein the magnetic coupling element comprises a magnetic material configured to engage a permanent magnet disposed on the external surface of the end portion of the lighting fixture.

4. The end cap of claim 1, wherein the end cap further comprises a hook element disposed on the cover plate; wherein the hook is configured to receive a tether for attachment to the light fixture.

5. The end cap of claim 1, wherein the cover plate comprises one or more tracks configured to engage a protrusion extending from the fixture body.

6. The end cap of claim 1, wherein the cover plate includes a V-cut slot.

7. A light fixture, comprising:
a fixture body having sidewalls and an end portion;
a lens;
a light source disposed within the fixture body so as to provide light through the lens;
an end cap having a cover plate and a lip portion, the cover plate having a shape adapted to cover at least a portion of the end portion of the fixture body, the end cap having a magnetic coupling element configured to removably secure the end cap to an external surface of the end portion;
wherein when the end cap is removably secured to the external surface of the end portion, the lip portion of the end cap covers a gap defined between the lens and the end portion of the fixture body, and
wherein when the end cap is removably secured to the external surface of the end portion, a side rib of the end cap covers a portion of an external surface of one of the sidewalls of the fixture body.

8. The light fixture of claim 1, wherein the magnetic coupling element comprises one or more permanent magnets disposed on the cover plate.

9. The light fixture of claim 1, wherein the light fixture comprises a permanent magnet disposed on the end portion of the fixture body, wherein the magnetic coupling element comprises a material configured to engage the permanent magnet disposed on the end portion of the fixture body.

10. The light fixture of claim 1, wherein the end cap comprises a hook disposed on the cover plate, wherein the hook is configured to receive a tether for attachment to the light fixture.

11. The light fixture of claim 1, wherein the cover plate is configured for slidable engagement with the fixture body such that the cover plate can slide between a first position and a second position relative to the fixture body.

12. The light fixture of claim 11, wherein the cover plate comprises one or more tracks configured to engage a protrusion extending from the fixture body.

13. The light fixture of claim 12, wherein the one or more tracks each comprise a slot in the end plate.

14. The light fixture of claim 1, wherein the lip reduces light leak of the light fixture.

15. The light fixture of claim 1, wherein the light fixture is a linear light fixture.

16. The light fixture of claim 1, wherein the light source comprises one or more light emitting diodes (LEDs).

* * * * *